US006233346B1

(12) United States Patent
Asahina

(10) Patent No.: US 6,233,346 B1
(45) Date of Patent: May 15, 2001

(54) SURFACE-MOUNTED ELECTROMAGNETIC SOUND GENERATOR

(75) Inventor: Masato Asahina, Fujiyoshida (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 0 days.

(21) Appl. No.: 09/439,762

(22) Filed: Nov. 15, 1999

(30) Foreign Application Priority Data

Nov. 29, 1998 (JP) ..... 10-353837

(51) Int. Cl.[7] ..... H04R 25/00
(52) U.S. Cl. ..... 381/412; 381/420; 381/433
(58) Field of Search ..... 381/412, 417, 381/420, 398, 396, FOR 159, FOR 160, 433

(56) References Cited

U.S. PATENT DOCUMENTS 4,251,807 * 2/1981 Hofer et al. ..... 381/412
5,467,323 * 11/1995 Sone ..... 381/398

* cited by examiner

*Primary Examiner*—Huyen Le
(74) *Attorney, Agent, or Firm*—Koda & Androlia

(57) ABSTRACT

A surface-mounted electromagnetic sound generator generates sound by causing a vibration plate to vibrate by an electromagnet which includes a yoke and a coil housed in a case. The yoke has a magnetic-circuit board an outer circumferential portion of which is provided with a drawn portion, the drawn portion being imbedded in the case by insert-molding when the case is molded.

1 Claim, 1 Drawing Sheet

SURFACE-MOUNTED ELECTROMAGNETIC SOUND GENERATOR

BACKGROUND OF THE INVENTION

1. Field of the Invention

This invention relates to a surface-mounted electromagnetic sound generator in which sound is generated by vibrating a vibration plate using an electromagnet. More particularly, the invention relates to an electromagnetic sound generator in which a yoke used in the electromagnet is insert-molded when the case of the sound generator is molded.

2. Description of the Related Art

A yoke employed in a surface-mounted electromagnetic sound generator of this kind according to the prior art usually is fixed within a case by means of a bonding agent. In order to reduce the thickness of the case, however, a yoke 4 is integrated with a case 2 made of plastic, as shown in FIGS. 3 and 4. Specifically, when a lower case 2*b* of the box-shaped case 2 is molded, a magnetic-circuit board 4*a* of the yoke 4 is imbedded by being insert-molded into side walls 2*c* and a bottom 2*d* of the case, as shown in FIG. 3. As a result, the magnetic-circuit board 4*a* is secured by being integrally molded with the lower case 2*b*.

When the case 4 is integrated with the lower case 2*b* in the manner described above, the bottom 2*d* of the lower case 2*b* is capable of being reinforced by the magnetic-circuit board 4*a* of the yoke 4. This makes it possible to reduce the thickness T of the bottom 2*d*. As a result, it is possible to reduce the thickness of the case housing the surface-mounted electromagnetic sound generator having this structure.

In the example of the prior art described above, it is possible to reduce the thickness of the bottom 2*d* of lower case 2*b*. However, if the thickness T is reduced to 0.3 mm, the bottom 2*d* may not be filled with molding material adequately when the lower case 2*b* is injection molded. Molding can be difficult to carry out. Consequently, even it is attempted to achieve a thinner device by thinning the bottom 2*d* of the lower case 2*b*, a major reduction in thickness is not possible.

Further, problems arise in a case where it is attempted to deal with this situation by insert-molding the yoke. Specifically, the thickness of both the side wall 2*c* and bottom 2*d* of the lower case 2*b* is small and, in addition, the magnetic-circuit board 4*a* of the yoke 4 is insert-molded with its outer peripheral portion being only slightly inserted into the side wall 2*c*. The result is that the yoke 4 is surrounded only by a molded portion of small thickness. This means that it is difficult to acquire sufficient strength to fix the yoke 4 and to provide enough strength to resist impact. A high strength is required especially since a coil 6, a ring-shaped magnet 8 and a vibration-plate supporting ring 12, which supports a vibration plate 10, are attached to the yoke 4.

SUMMARY OF THE INVENTION

Accordingly, an object of the present invention is to provide a surface-mounted electromagnetic sound generator in which yoke fixing strength can be increased and the thickness of the magnetic sound generator reduced.

According to the present invention, the foregoing object is attained by providing a surface-mounted electromagnetic sound generator for generating sound by causing a vibration plate to vibrate by an opposing electromagnet which includes a yoke and a coil housed in a case, wherein the yoke has a magnetic-circuit board an outer circumferential portion of which is provided with a drawn portion, the drawn portion being imbedded in the case by insert-molding when the case is molded.

Further, the drawn portion is formed by raising the outer circumferential portion of the magnetic-circuit board and bending a leading edge of this portion in an outward direction.

Thus, the surface-mounted electromagnetic sound generator according to the present invention includes a yoke having a magnetic-circuit board formed to have a drawn portion. The drawn portion is formed by raising the outer circumferential portion of the magnetic-circuit board and bending a leading edge of this portion in the outward direction. In the present invention, the drawn portion is insert-molded in the lower case when the lower case, which constitutes part of the case, is molded, thereby imbedding the drawn portion in the lower part of the side wall of the lower case. As a result, the drawn portion of the yoke is inserted deeply into the lower case along the side wall thereof to increase the thickness of the portion that surrounds the drawn portion. The strength with which the drawn portion is anchored is thus increased, thereby making it unnecessary to envelope the magnetic-circuit board of the yoke by forming a bottom portion across the entirety of the lower part of the lower case. Accordingly, even if a thin-wall area such as the bottom of the lower case is reduced, sufficient strength is assured and it is unnecessary to mold resin for the entire underside of the lower case. Inadequate filling of resin when the lower case is molded can be eliminated.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of the present invention will now be described in detail with reference to the accompanying drawings.

Figure 1:
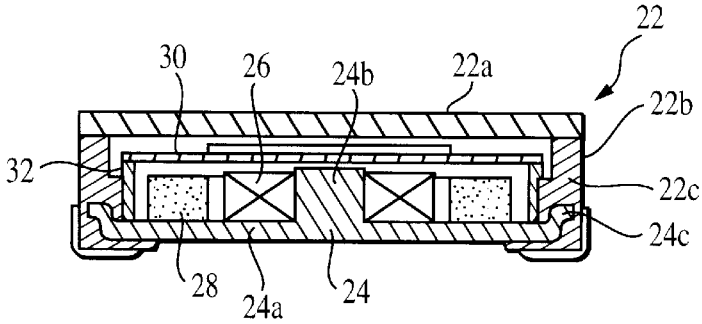
FIG. 1 is a sectional view illustrating a surface-mounted electromagnetic sound generator according to an embodiment of the present invention.
Figure 2:
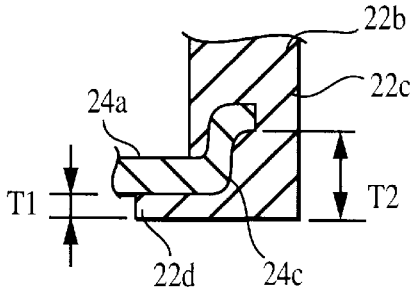
FIG. 2 is a partially enlarged view of the surface-mounted electromagnetic sound generator shown in FIG. 1.
Figure 3:
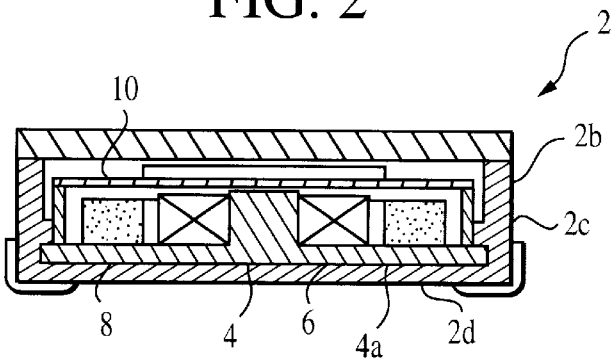
FIG. 3 PRIOR ART
FIG. 3 is a sectional view illustrating a surface-mounted electromagnetic sound generator according to the prior art.
Figure 4:
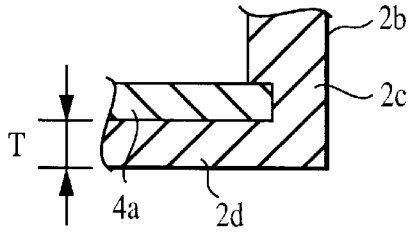
FIG. 4 PRIOR ART
FIG. 4 is a partially enlarged view of the surface-mounted electromagnetic sound generator shown in FIG. 3.

FIG. 1 is a sectional view illustrating a surface-mounted electromagnetic sound generator according to an embodiment of the present invention, and FIG. 2 is a partially enlarged view of the surface-mounted electromagnetic sound generator shown in FIG. 1.

The surface-mounted electromagnetic sound generator has a case 22 made of plastic. In this embodiment the case 22 has a box-like external configuration the planar shape of which is rectangular and is constituted by a plate-shaped upper case 22*a* and a frame-shaped lower case 22*b*.

A yoke 24 comprises a disk-shaped magnetic-circuit board 24*a* and a center pole portion 24*b* which rises from the center of the circuit board. The magnetic-circuit board 24*a* of the yoke 24 is formed to have a drawn portion 24*c* on its outer circumference. The drawn portion 24*c* is formed by raising the outer circumferential portion of the magnetic-circuit board 24*a* and bending the leading edge of the raised portion in an outward direction. As a result, the cross section of the drawn portion 24*c* is generally S-shaped.

A ring-shaped coil 26 is mounted on the outer periphery of the center pole 24*b* of yoke 24. A ring-shaped magnet 28 is placed on the magnetic-circuit board 24*a* of yoke 24 so as to surround the coil 26.

A vibration plate 30 is supported at its outer periphery by a ring-shaped supporting frame 32 placed upon the magnetic-circuit board 24*a* so as to surround the magnet 26.

In the surface-mounted electromagnetic sound generator constructed as set forth above, the drawn portion 24*c* of the magnetic-circuit board 24*a* of yoke 24 in imbedded by being insert-molded in the lower part of the side wall 22*c* of lower case 22*b*. As shown in FIG. 2, the drawn portion 24*c* in inserted deeply into the lower case 22*b* along the side wall 22*c*. Consequently, the strength with which the lower case 22*b* and yoke 24 are joined together is raised greatly. In this embodiment, therefore, the entire lower face of the magnetic-circuit board 24*a* of yoke 24 need not be covered by the bottom of the lower case 22*b* to increase strength. As a result, the lower case 22*b* need not be formed to have a bottom across its entire lower side. Rather, the lower case 22*b* is formed to have a ring-shaped edge 22*d* just large enough to penetrate below part of the underside of the drawn portion 24*c*. The ring-shaped edge 22*d* defines a hole on its inner side through which the magnetic-circuit board 24*a* is exposed.

Thus, in this embodiment as described above, the lower case 22*b* need not be formed to have a bottom so as to cover the entire underside of the magnetic-circuit board 24*a* of coke 24 but is instead formed to have the edge 22*d* so as to cover only the circumferential portion of the underside of the magnetic-circuit board 24*a*. This eliminates the problem encountered in the prior art, namely inadequate filling of molding resin caused by the resin not reaching the center of the bottom. Accordingly, the thickness T1 of the edge 22*d* can be made less than 0.3 mm. In this embodiment, the thickness T1 is set to 0.15 mm.

Even if it is necessary to provide a thickness of 0.3 mm beneath the drawn portion 24*c* in order to eliminate insufficient filling of resin at the time of molding and maintain a fixed strength, in this embodiment it will suffice if the thickness T2 from the leading edge of the drawn portion 24*c* to the lower end face of the lower case 22*b* is 0.3 mm or greater. Accordingly, if the height of the drawn portion 24*c* is set to approximately 0.3 mm, the problems of inadequate filling of resin and insufficient strength are solved.

It should be noted that the height of the drawn portion 24*c* and the thickness of the edge 22*d* are set and/or changed to conform to the material and shape of the lower case 22*b* and the shape of the drawn portion 24*c*, etc. Hence the numerical values cited in this embodiment do not limit the present invention in any way.

Thus, in accordance with the present invention, a high joining strength can be obtained by inserting the drawn portion of a yoke deeply into lower case when the yoke is insert-molded in the lower case. As a result, the bottom of the lower case, which comprises a thin-walled portion, need no longer be formed over the entire underside of the lower case, unlike the prior-art arrangement in which the full bottom is required for the sake of mechanical reinforcement. Thus it is possible to eliminate the central portion of the lower-case bottom that tends to experience the problem of inadequate filling of resin at the time of molding. This problem, therefore, is solved.

Because it is no longer necessary to form a thick bottom for the lower case in consideration of inadequate filling of resin, a thin device can be obtained by reducing the thickness of the case while maintaining impact strength.

As many apparently widely different embodiments of the present invention can be made without departing from the spirit and scope thereof, it is to be understood that the invention is not limited to the specific embodiments thereof except as defined in the appended claims.

What is claimed is:

1. A surface-mounted electromagnetic sound generator for generating sound by causing a vibration plate to vibrate by an opposing electromagnet which includes a yoke and a coil housed in a case, wherein said yoke has a magnetic-circuit board having an outer circumferential portion of which is provided with a drawn portion, said drawn portion is imbedded in said case by insert-molding when said case is molded and said drawn portion comprises an upwardly bent portion of the outer circumferential portion of said magnetic-circuit board and a leading edge of the upwardly bent portion bent in an outward direction to form said drawn portion in a substantially S shape.

* * * * *